United States Patent [19]

Feldkämper et al.

[11] 4,352,468

[45] Oct. 5, 1982

[54] APPARATUS FOR THE UNINTERRUPTED WITHDRAWAL OF WEBS FROM REELS OF WEBS WHICH ARE TO BE UNWOUND SUCCESSIVELY

[75] Inventors: Richard Feldkämper; Fritz Achelpohl, both of Lengerich of Westphalia, Fed. Rep. of Germany

[73] Assignee: Windmöller & Hölscher, Lengerich of Westphalia, Fed. Rep. of Germany

[21] Appl. No.: 214,730

[22] Filed: Dec. 9, 1980

[30] Foreign Application Priority Data

Dec. 14, 1979 [DE] Fed. Rep. of Germany ..... 2950493

[51] Int. Cl.[3] ..... B65H 19/16; B65H 19/08

[52] U.S. Cl. ..... 242/58.4; 156/504

[58] Field of Search ..... 242/58.4, 58.3, 58.1; 156/502, 504

[56] References Cited

U.S. PATENT DOCUMENTS

| | | | |
|---|---|---|---|
| 1,868,117 | 7/1932 | Pancoast | 242/58.4 |
| 1,892,974 | 1/1933 | Wood | 242/58.3 |
| 2,950, 874 | 8/1960 | Bennett | 242/58.3 |
| 3,309,035 | 3/1967 | Degutis | 242/58.1 |

FOREIGN PATENT DOCUMENTS

| | | |
|---|---|---|
| 1046471 | 10/1956 | Fed. Rep. of Germany . |
| 968704 | 3/1958 | Fed. Rep. of Germany . |
| 92944 | 10/1972 | Fed. Rep. of Germany . |

*Primary Examiner*—Edward J. McCarthy
*Attorney, Agent, or Firm*—Fleit & Jacobson

[57] ABSTRACT

A continuous web unwinder comprising at least one operative station for an operative reel of web that is being unwound and one reserve station for a full reel comprises a direction-changing roller for the web unwound from the operative reel that, on depletion of the operative reel, is displaceable to the reserve station where it defines a nip together with a circulating belt for introducing an adhesive-coated leading end from the full reel.

14 Claims, 2 Drawing Figures

Figure 1:
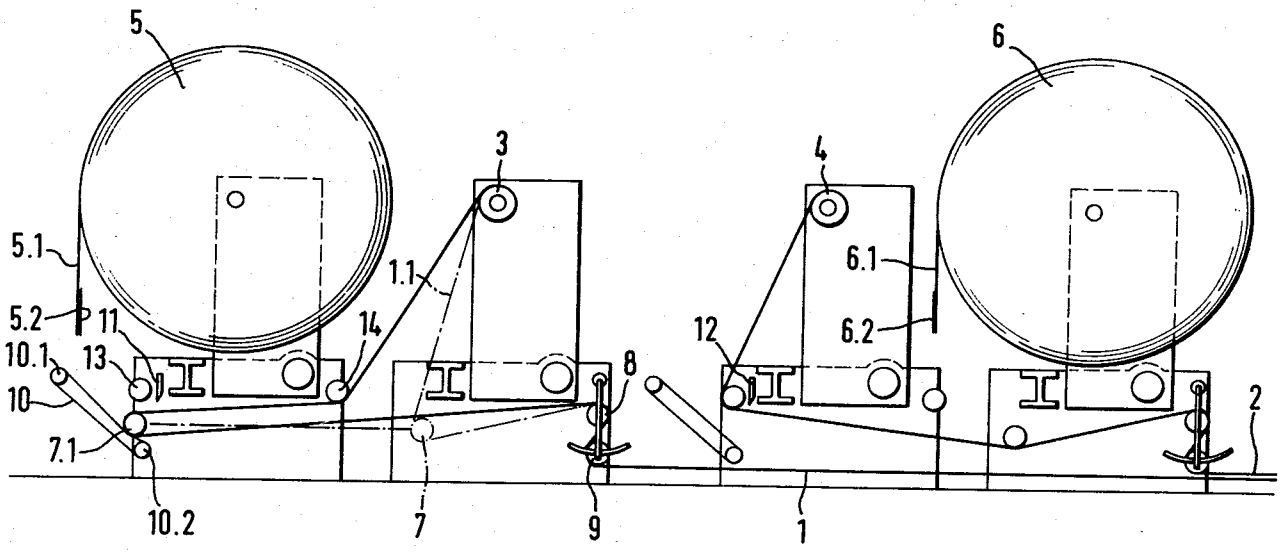

APPARATUS FOR THE UNINTERRUPTED WITHDRAWAL OF WEBS FROM REELS OF WEBS WHICH ARE TO BE UNWOUND SUCCESSIVELY

The invention relates to an apparatus for the uninterrupted withdrawal of webs from reels of webs which are to be unwound successively, comprising two bearings for the reels to be unwound alternately and guide rollers for the webs running therefrom and means for pressing to the web running from the depleting reel the adhesively coated leading web end of the last reel to have been mounted in its bearings and that has been set in rotation.

In an apparatus of this kind known from DE-AS No. 10 46 471, the leading web end of the new reel is adhered to the depleting web by providing two pressure rollers associated with the alternately employed new reels in such a way that they press the depleting web to the last new reel to have been inserted. However, this new reel is driven in an opposite sense to the depleting reel so that, according to the different directions of rotation of the reels, the outside and the inside of the web are alternately at the top.

In another apparatus of the aforementioned kind known from DE-PS No. 968 704, the depleting web is again adhered to the newly employed reel by providing a pressure roller which presses the depleting web to the new reel. The projecting trunnions of the depleting reel are inserted in pivotable bearings so that, after the depleting reel has been swung away, the new reel can be so inserted in the first bearing formed by supporting rollers that the web is withdrawn therefrom without changing the direction of rotation of the reels. Apart from the fact that pivotable bearings have to be provided, the known apparatus is suitable only for unwinding reels of web that are provided with throughgoing shafts, i.e. so called reel-spools.

Finally, roller stars such as those described in DL-PS No. 92 944 are known for flying reel changes. However, these require a complicated construction so that their use is uneconomical particularly if several have to be juxtaposed to enable, for example, a plurality of parallel webs to be withdrawn for the production of multi-layer sacks.

It is the problem of the present invention to provide an apparatus of the aforementioned kind in which reels can be unwound even if they are provided with recesses for bearing cones therefor and, by reason of the simple construction, a number of which can be economically juxtaposed to produce multi-layer webs.

According to the invention, this problem is solved in that beneath the leading end of the web running from the last reel to have been inserted there is a belt passing over direction-changing rollers or a web passing over direction-changing rollers, which belt or web takes the lowered leading web end with it, and that the pressing means comprise a backing roller over which the web from the depleting reel and the leading end taken along by the belt or web pass in such a way that its adhesive application is pressed thereby against the depleting web.

For adhering the leading web end of the rear reel as viewed in the direction of web withdrawal to the web of the depleting front reel, the belt desirably consists of a conveyor belt which passes over direction-changing rollers and against the upper run of which there can be applied the backing roller which is in the form of a direction-changing roller for the depleting web and the bearings of which are displaceable in parallel in the machine frame. The conveyor belt leads the leading web end to the depleting web, a good bond to the depleting web being obtained after the leading end has entered the nip formed by the upper run and the backing roller. The conveyor belt may be inclined towards the backing roller.

In a further development of the invention, for the purpose of adhering the leading web end of the front reel as viewed in the direction of web withdrawal to the web of the depleting rear reel, the depleting web from the rear reel forms the web which takes along the leading end of the front reel. The adhesive application of the leading end touches the depleting web, a good bond being obtained in that the adhesive application is pressed against the depleting web as the leading end runs over the guide roller in the form of the backing roller.

Preferably, the backing roller is movable parallel to itself between its limiting positions on the one hand below the new front reel and on the other hand in its position when applied to the conveyor belt where it extends the web from the front reel into a loop.

In a further development of the invention, in the case of a plurality of unwinding apparatuses in a row for withdrawing a plurality of parallel webs, the leading web end of the rear reel of the unwinding apparatus following the first unwinding apparatus is lowerable onto the web withdrawn from the first unwinding apparatus or the preceding unwinding apparatus for the purpose of being taken along, and to press the adhesive application against the web withdrawn from the front depleting reel there is a pressure roller co-operating with the backing roller. In this construction, the conveyor belt can be dispensed with because its function is performed by the web coming from the first unwinding apparatus. The adhesive application is disposed on the side of the leading end opposite to this web, so that it is impossible for it to adhere to the web which only serves to feed the leading end to the depleting web with which adhesion takes place.

Figure 2:
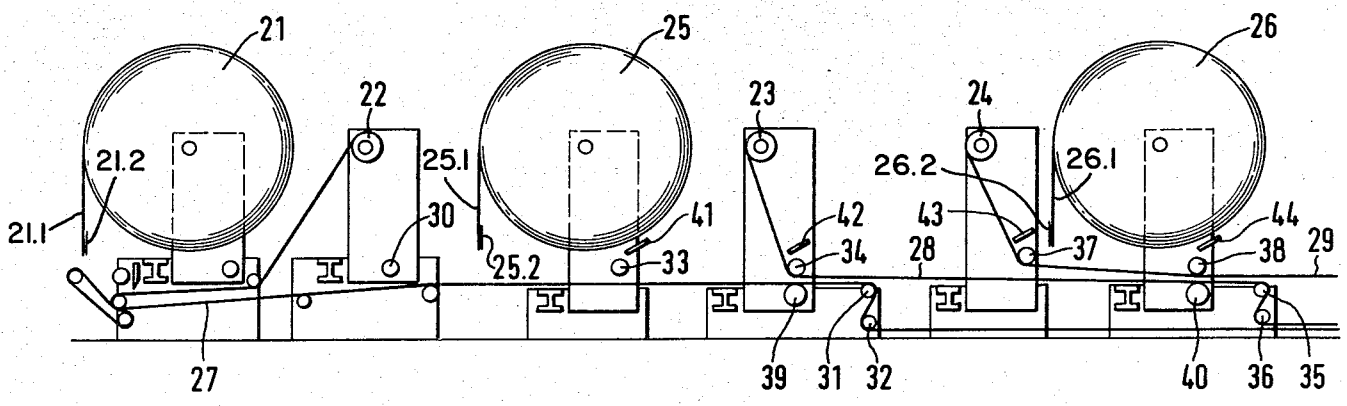

Examples of the invention will now be described in more detail with reference to the drawing, wherein:

FIG. 1 is a diagrammatic side elevation of two juxtaposed unwinding apparatuses equipped for flying reel changes, and FIG. 2 is likewise a diagrammatic side elevation of three juxtaposed unwinding apparatuses equipped for flying reel changes.

In the installation shown in FIG. 1 and comprising two juxtaposed unwinding apparatuses, two parallel webs 1, 2 are withdrawn from the reel 3 of the first unwinding apparatus and the reel 4 of the second unwinding apparatus. In the two unwinding apparatuses equipped for flying reel changes, replacement reels 5, 6 are mounted in the associated machine frames next and parallel to the reels 3, 4. The leading web ends 5.1 and 6.1 of the reels 5, 6 are suspended substantially tangentially therefrom and are provided on the inside or outside with adhesive coatings 5.2 and 6.2.

The web 1 first runs along the chain-dotted line 1.1 over guide rollers 7, 8, 9. Of these guide rollers, the guide roller 7 is displaceable to the position 7.1 in a horizontal direction along the chain-dotted line. In this position 7.1, the guide roller 7 makes contact with the endless conveyor belt 10 which passes over the direction-changing rollers 10.1 and 10.2 and is disposed beneath the depending leading web end 5.1.

To adhere the leading web end 5.1 to the web 1 coming from the depleting reel 3, the guide roller 7 is moved from its right-hand position to its left-hand position 7.1 in which it extends the web 1 while deflected over the guide roller 14 to form a loop and in which it drives the conveyor belt 10 by frictional contact. As soon as the reel 3 has become almost exhausted, the new reel 5 is set into rotation by a drive (not shown) so that the leading web end 5.1 strikes the conveyor belt 10 with its non-adhesive side and is taken along thereby towards the guide roller 7 located at the position 7.1. The leading web end 5.1 then enters a clamping nip formed by the conveyor belt 10 and the guide roller 7 so that the adhesive coating 5.2 adheres to the web 1. The depleting web 1 is thereupon severed from the almost exhausted reel 3 by means of the lowerable knife 11. The guide roller 7 is thereupon returned to its right-hand limiting position, the web 1 withdrawn from the reel 5 then running over the guide roller 13 disposed above the conveyor belt 10.

The two unwinding apparatuses shown in FIG. 1 correspond to each other in construction. The reel change just before depletion of the reel 5 will therefore be explained with reference to the right-hand unwinding apparatus in FIG. 1 in which the reel 4 corresponding to the reel 5 is almost completely unwound.

If the leading web end 6.1 of the replacement reel 6 is to be spliced to the web 2 of the depleting reel 4, the reel 6 is set in rotation in such a way that the leading web end 6.1 strikes the depleting web 2. Since the adhesive application 6.2 is disposed on the outside of the end 6.1, it comes to lie in the depleting web 2 and is pressed against same during passage over the next guide roller so that a good bond is obtained. The web 2 is subsequently severed from the depleting reel 4 by lowering the knife 12.

In the installation shown in FIG. 2, three unwinding apparatuses equipped for flying reel changes are so disposed behind each other that a three-layer web can be led out from the installation.

In FIG. 2, the left-hand unwinding apparatus corresponds in its construction to the two unwinding apparatuses described with reference to FIG. 1.

The unwinding apparatuses following the first unwinding apparatus of FIG. 2 differ from the unwinding apparatuses of FIG. 1 substantially in that they omit the conveyor belt 10. In the subsequent unwinding apparatuses, the leading web ends 25.1 and 26.1 depending from the rear reserve reels have adhesive coatings 25.2 and 26.2, respectively, and are taken along by the web coming from the preceding unwinding apparatus in a manner such that they can be adhered to the web of the depleting front reel. The leading web end 21.1 has an adhesive coating 21.2 and is handled in the same manner as the web end 5.1 of FIG. 1.

The webs 27 to 29 are alternately withdrawn from the reels 21 or 22, 25 or 23, and 24 or 26, respectively. Guide rollers 30, 33, 34 and 38 are provided to guide the webs. Further, web 27 passes around rollers 31 and 32, and web 28 passes around rollers 35 and 36. Pressure rollers 39, 40 provided beneath the guide rollers 34 and 38 can be raised and lowered and applied to the guide rollers 34 or 38, respectively. After starting the reel 26, the prepared leading web end of the reel 26 is engaged by the web 29 and pressed by the guide roller 38 onto the web 29 and bonded thereto.

If a reel change is to take place for the web 28, the reel 25 is started. The prepared leading web end is taken along by the web 27. It does not bond to the web 27 because the adhesive layer 25.2 is applied to the inside. The leading web end reaches the zone of the guide or pressure rollers 34, 39 which for this purpose are placed together for a short period, whereby an intimate contact and bond is obtained between the leading end from the reel 25 to the web 28 of the depleting reel 23. After bonding, the respective pressure rollers 39 or 40 are returned to the starting position and the web ends of the depleting reels are cut off. Severing knives 41 to 44 are provided for this purpose.

We claim:

1. Apparatus for the uninterrupted withdrawal of webs from reels of webs which are to be unwound successively, the webs having adhesively coated leading web ends, said apparatus comprising bearing means for supporting the reels to be unwound alternately, guide means for guiding the webs running from the reels, and means for pressing to a web running from a depleting reel the adhesively coated leading web end of another reel, the another reel having been set in rotation to advance a lowered leading web end, said means for pressing comprising a belt (10) disposed beneath the leading end (5.1, 6.1) of the web running from another reel (3, 4, 5, 6; 21, 22, 23, 24, 25, 26), direction-changing rollers (10.1, 10.2) for guiding movement of said belt, said belt advancing the lowered leading web end (6.1; 25.1, 26.1), and pressing means comprising a backing roller (7; 34, 38) over which the web from the depleting reel (3, 4; 22, 23, 24) and the leading end taken along by the belt (10) pass in such a way that the backing roller and belt cooperate with each other to press the adhesively coated leading web end against the depleting web.

2. Apparatus according to claim 1, characterised in that, for adhering the leading web end (5.1, 21.1) of a rear reel (5, 21) as viewed in the direction of web withdrawal to the web of a depleting front reel (3, 22), the belt consists of a conveyor belt (10) which passes over direction-changing rollers (10.1, 10.2) and against the upper run of which there can be applied the backing roller which is in the form of a direction-changing roller (7) for the depleting web and the bearings of which are displaceable in parallel in the machine frame.

3. Apparatus according to claim 2, characterised in that the conveyor belt is inclined towards the backing roller (7).

4. Apparatus according to one of claims 1 to 3, characterised in that said means for pressing further comprises a guide roller and a pressure roller movable towards and away from the guide roller, a leading web end (6.1, 26.1) of a front reel (6, 26) as viewed in the direction of web withdrawal being adhered to the web of a depleting rear reel (4, 24) by cooperation between said guide roller and said pressure roller, the depleting web from the rear reel forming a web which guides the leading end of the front reel between the guide roller and the pressure roller.

5. Apparatus according to claim 2 or 3, characterised in that the backing roller (7) is movable parallel to itself between limiting positions, one of the limiting positions being below the new front reel (6) and the other limiting position (7.1) being when the backing roller is applied to the conveyor belt (10), the backing roller when in the other limiting position extending the web from the front reel into a loop.

6. Apparatus according to one of claims 1 to 3, further comprising a plurality of unwinding apparatuses in a row for withdrawing a plurality of parallel webs (27, 28, 29), a first of said webs (27) being fed by a first pair of unwinding apparatus 21, 22 positioned with respect to a web conveying direction at an upstream end of the apparatus and a second of said webs (28) being fed by a second pair of unwinding apparatus (23, 25) positioned downstream of the first pair, the adhesively coated leading web end (25.1) of a reel (25) supported by one of the second pairs of unwinding apparatus being lowerable onto the first web (27) withdrawn from a reel supported by one of the first pair of unwinding apparatus for the purpose of being taken along by the first web, and a pressure roller (39, 40) co-operating with a backing roller (34, 38) for pressing the adhesively coated leading web end onto the web being withdrawn from the depleting reel.

7. Apparatus according to claim 6, characterised in that the pressure roller (39, 40) can be raised and lowered.

8. Apparatus according to one of claims 1 to 3, further comprising a movable knife (11, 12, 41–44) for severing the web from the depleting reel.

9. Apparatus according to claim 6, further comprising a movable knife (11, 12, 41–44) for severing the web from the depleting reel.

10. An apparatus for the uninterrupted withdrawal of webs from reels of webs which are to be successively unwound, the webs having adhesively coated leading web ends, said apparatus comprising:

first means for supporting and for rotating a first reel;

second means for supporting and for rotating a second reel, said first and said second means supporting the reels with their axes parallel;

guide means for guiding movement of webs being withdrawn from reels through the apparatus, the first means having bearing means for supporting a reel upstream, with respect to the direction of movement of the webs, of bearing means of the second means, a belt disposed under the bearing means of said first means so as to be contacted by a leading web end unwound from the first reel; and said guide means including a backing roller movable between a first position and a second position, the backing roller in the second position forming a nip with the belt and deflecting a web being withdrawn from the second reel to form a loop so that the web passes through the nip, the leading web end of a web carried by the first reel being advanced by rotation of said first reel by said first means and being carried into the nip by said belt, said backing roller cooperating with said belt to press said leading web end extending from the first reel into contact with the web being withdrawn from the second reel.

11. An apparatus according to claim 10, wherein the adhesive coated leading web end of a web carried by the second reel is oriented so that the adhesive coating contacts a web being withdrawn from the first reel when the leading end is advanced by rotation of the second reel.

12. An apparatus according to claim 11, wherein said guide means includes a roller positioned to press the leading end of the web being withdrawn from the second reel into contact with the web being withdrawn from the first reel to ensure a bond therebetween.

13. An apparatus according to one of claims 10 to 12, further comprising means for severing a web, said severing means being operable to sever a web being withdrawn from one reel after the leading end of the next web has been secured thereto.

14. An apparatus according to claim 10 or 11, further comprising:

third means downstream of said second means for supporting and for rotating a third reel;

fourth means downstream of said third means for supporting and for rotating a fourth reel;

said guide means including a guide roller for guiding movement of webs being withdrawn from said third and said fourth reels and a pressure roller movable towards and away from said guide roller, a web being withdrawn from one of said first and said second reels passing below said third and fourth reels and passing between said guide roller and said pressure roller so that the leading end of a web advanced from the third reel contacts the web passing below the third reel and is carried between said guide roller and said pressure roller, said pressure roller being movable towards said guide roller to press the leading end advanced from the third reel into contact with a web being withdrawn from the fourth reel.

* * * * *